United States Patent [19]

Dubois

[11] Patent Number: 4,595,112

[45] Date of Patent: Jun. 17, 1986

[54] THERMAL CONTAINER

[75] Inventor: Robert A. Dubois, Marion, Ohio

[73] Assignee: Greif Bros. Corporation, Delaware, Ohio

[21] Appl. No.: 630,061

[22] Filed: Jul. 12, 1984

[51] Int. Cl.[4] ..... B65D 5/56; B65D 25/14

[52] U.S. Cl. ..... 220/5 R; 220/410; 220/412; 220/465; 220/902

[58] Field of Search ..... 220/408, 410, 465, 466, 220/902, 411, 412, 413, 5 R; 206/545, 523; 215/13 R; 229/5.7

[56] References Cited

U.S. PATENT DOCUMENTS

| | | | |
|---|---|---|---|
| 2,054,754 | 9/1936 | Kellogg | 220/465 |
| 2,146,381 | 2/1939 | Rheem | 220/466 X |
| 2,152,610 | 3/1939 | Studley | 229/5.7 |
| 2,511,481 | 6/1950 | Schneider | 229/5.7 X |
| 2,555,788 | 5/1951 | Donaldson | 206/545 |
| 2,989,208 | 6/1961 | Gibbs, Jr. | 229/5.7 X |
| 3,092,277 | 6/1963 | Brim | 215/13 R |
| 3,262,628 | 7/1966 | Heisler et al. | 220/465 X |
| 3,356,243 | 12/1967 | Piker | 215/13 R |
| 3,432,666 | 3/1969 | Nash et al. | 206/523 X |
| 3,437,231 | 4/1969 | Carpenter, Jr. | 220/465 |
| 3,472,568 | 10/1969 | Southwick | 220/410 X |
| 4,004,709 | 1/1977 | Simkus | 220/5 R X |
| 4,114,759 | 9/1978 | Maloney, Jr. | 220/410 X |
| 4,228,908 | 10/1980 | Tweeton | 220/412 X |
| 4,241,843 | 12/1980 | Walker | 220/902 X |
| 4,286,723 | 9/1981 | Schutz | 220/5 R |

*Primary Examiner*—Allan N. Shoap

*Attorney, Agent, or Firm*—Kane, Dalsimer, Kane, Sullivan and Kurucz

[57] ABSTRACT

The present invention pertains to a container for shipping and storing a substance at a constant temperature. The container is made up of an inner liner with outlets, an insulating shell enveloping the liner and a fiber drum which houses the shell and the liner. A slip-on removal cover is used to close the drum.

1 Claim, 5 Drawing Figures

THERMAL CONTAINER

BACKGROUND OF THE INVENTION

1. Field of Invention

This invention pertains to insulated containers and more particularly to a container for storing and shipping articles which must be heavily insulated from the elements so that they can be maintained at constant temperatures.

2. Description of the Prior Art.

Certain materials in the form of liquids, semi-liquids and powders must be maintained at a preselected temperature during shipping. Heretofore the practice has been to put each type of material in a particular vessel and then to place said vessel in an insulated container. Since the vessels for different materials vary in size and shape, specialized insulated containers have to be made.

OBJECTIVES AND SUMMARY OF THE INVENTION

In view of the shortcomings of the prior art, a principal objective of the present invention is to provide a container which is usable as a shipping means for any liquid, semi-liquid or powdered substance.

Another objective is to provide a container having a standard size so that it can be handled, shipped and stacked together with other similar sized and shaped containers.

An additional objective is to provide a container which may be mass-produced and assembled.

Other objectives and advantages of the invention shall become apparent in the following description of the invention. According to this invention, a thermal container comprises a liner, a molded insulating shell enveloping the liner and a drum which houses the shell. A drum cover is on the drum mouth to seal the whole assembly.

DESCRIPTION OF THE PREFERRED EMBODIMENT

Figure 1:
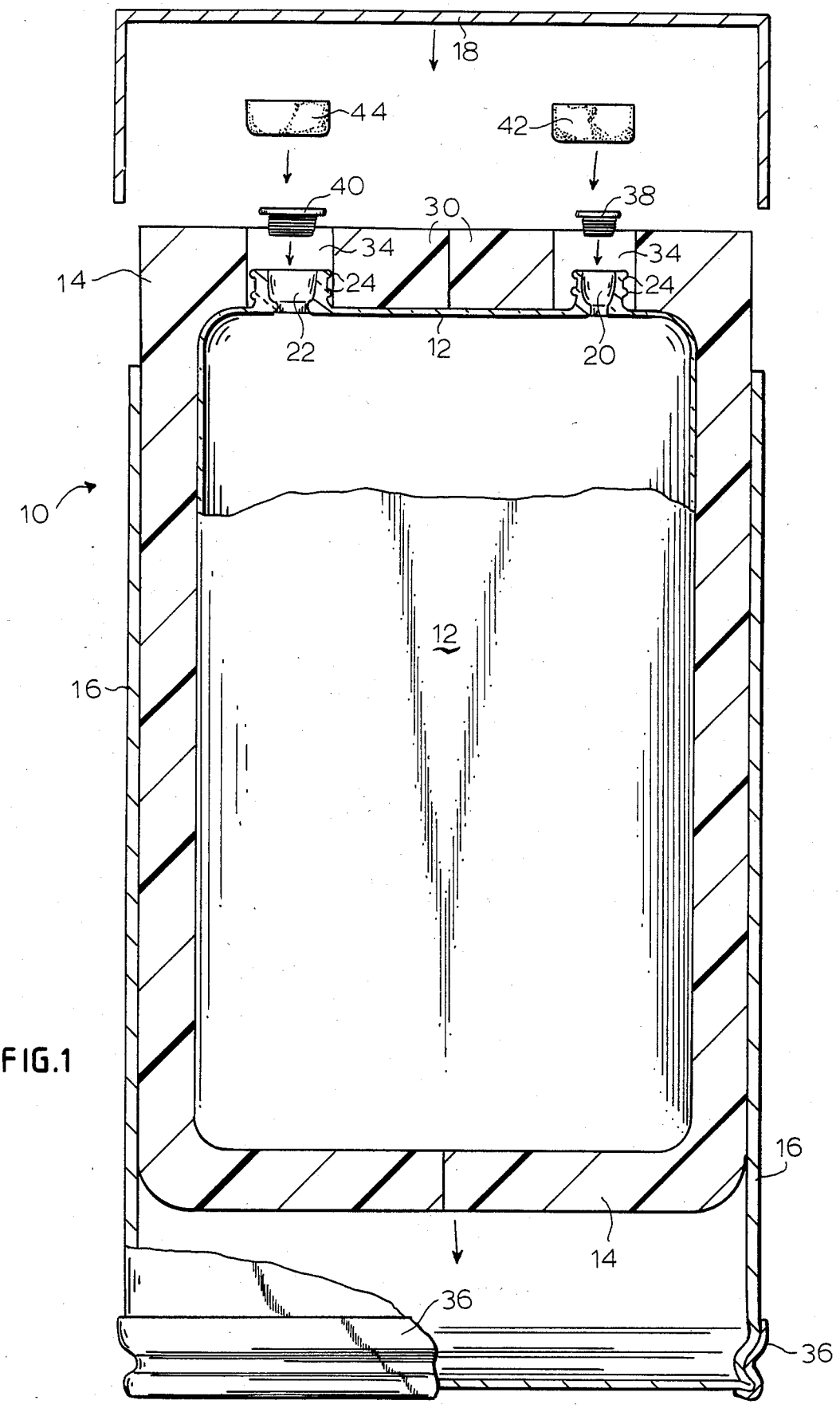
FIG. 1 is an exploded view of a thermal container constructed in accordance with the invention.
Figure 2:
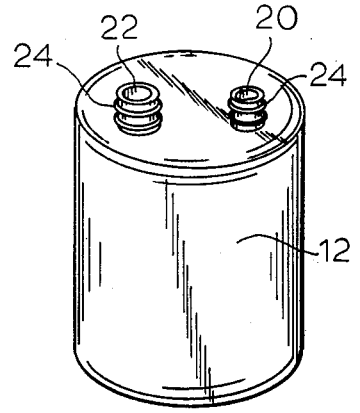
FIG. 2 shows the liner.

As shown in FIG. 1, according to this invention, a thermal container 10 comprises an inner liner 12, an insulating shell 14 and a fiber drum 16. A fiber cover 18 fits over and partially overlaps the drum to seal the container. Details of the liner are illustrated in FIG. 2. Liner 12 is made of a plastic material which is thick enough to substantially retain its shape. Preferably the liner is made by a standard blow molding technique from polyethylene and is about 40 mil thick. The liner is generally cylindrical and it is provided with a first neck 20 with an inner diameter of about ¾" and a second neck 22 with an inner diameter of 2". Circumferential ribs 24 are provided as reinforcing means for the necks.

Figure 3:
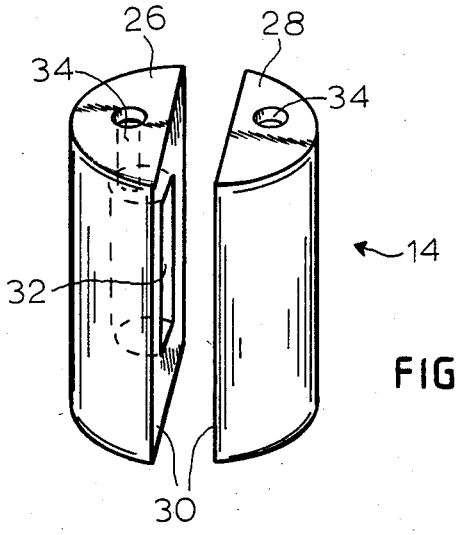
FIG. 3 shows the insulating shell.

Shell 14 (FIG. 3) is preferably made of two identical members 26 and 28. The members are shaped so that when they are put together by abutting surfaces 30, they form cylindrical shell 14. Each member is provided with a semicylindrical cavity 32 and a top hole 34 so that when the shell is formed the cavities of the two parts cooperate to form a complementary housing for the lining of FIG. 1. Holes 34 provide access to the respective necks 20, 22.

Shell members 26, 28 are made out of a material which is very light but also a good thermal insulator. For example these members may be made of expandable polystyrene by standard molding techniques.

Finally, drum 16 is a fiber drum with a steel chime bottom 36. Bottom 36 permits several drums to be stacked, several drums to be stacked, one on top of the other or to be rolled from one location to another. The drum is dimensioned so that shell 14 may be slipped into the drum with relative ease but without any extra play.

As shown in FIG. 1, two properly dimensioned threaded plugs 38, 40 are provided to close necks 20, 22 respectively. In order to insure the complete insulation of liner 12, two disc-shaped inserts 42, 44 are used to plug holes 26, 34 as shown. These inserts are made to fit snugly within the respective holes.

Figure 5:
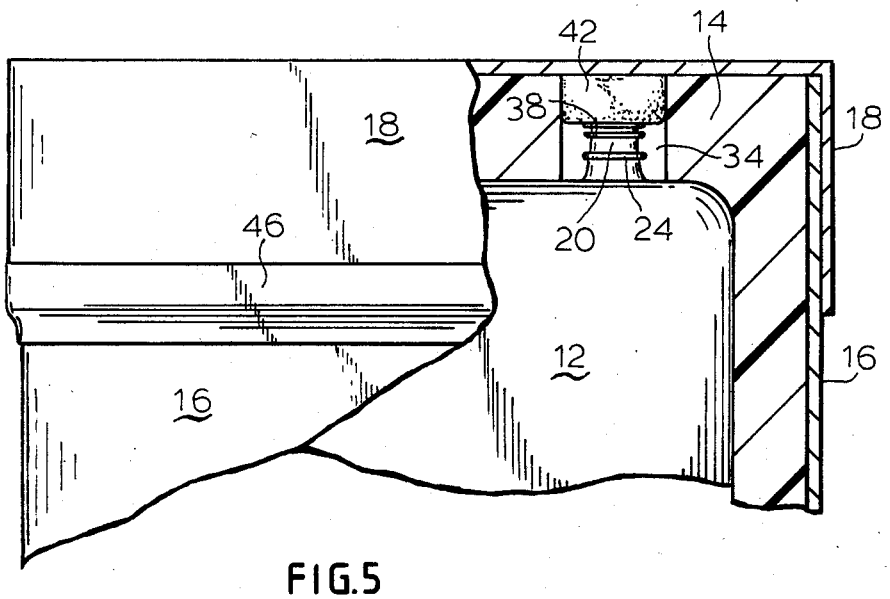
FIG. 5 is an enlarged partial sectional view of FIG. 4.
Figure 4:
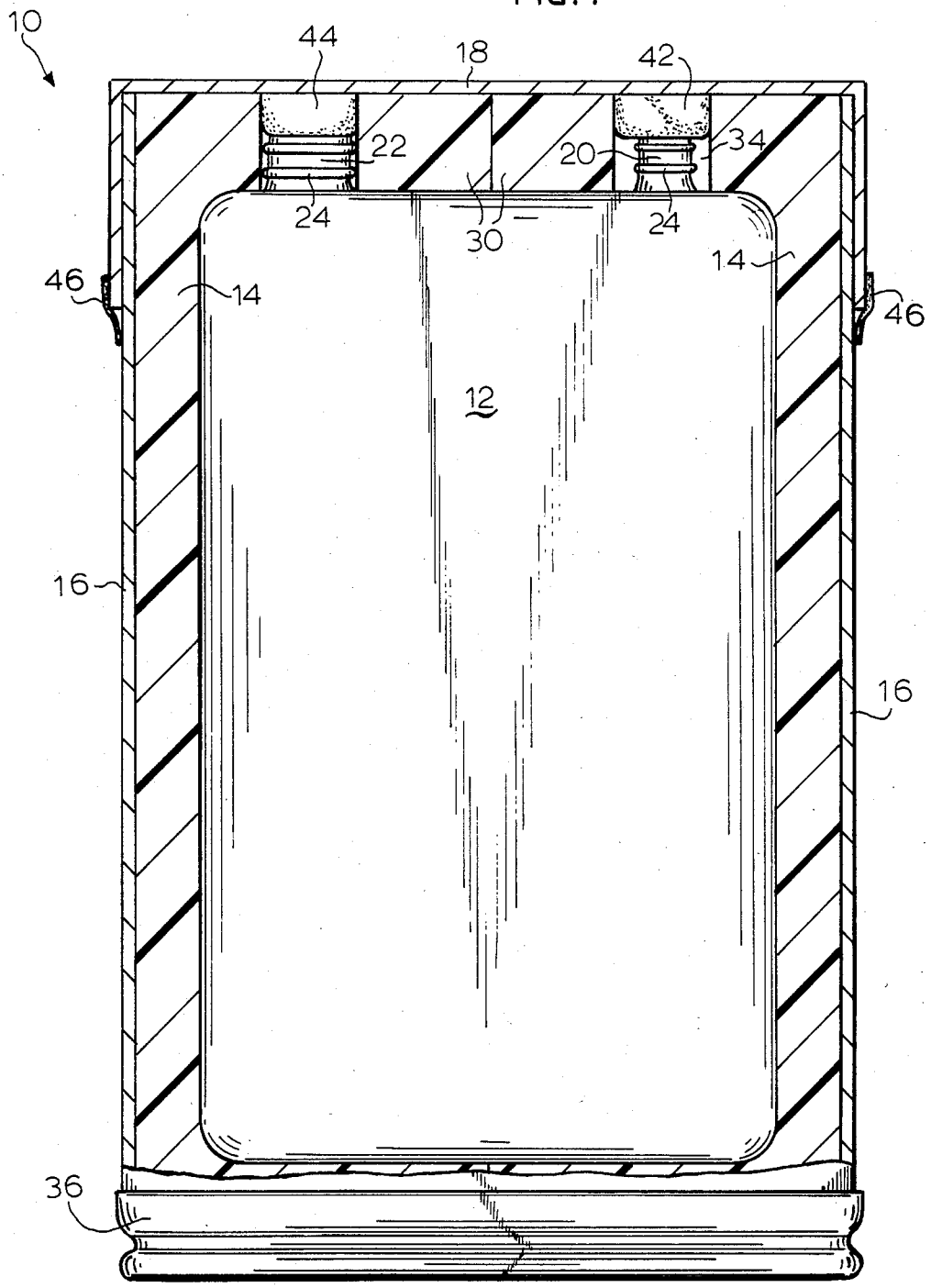
FIG. 4 shows a partial sectional view of the assembled thermal container.

The container is assembled and used as follows. First liner 12 is inserted in cavity formed by the two members of shell 14. The liner is flexible enough so that necks 20, 22 are pushed slightly inward in this process so that in the final position they are disposed within holes 34 as shown in FIG. 1. Next, plugs 38, 40 and inserts 42, 44 are installed and the assembled shell is slipped into drum 16. The drum is then closed by applying slip-on cover 18. In this form the container is shipped to the filling site. For filling, the cover is slipped off and inserts and plugs are removed. The container is now ready to be filled. A liquid, semi-liquid or powder material is poured through one of the necks while the other neck is used for venting excess air from the container. When the container is filled, the plugs, inserts and slip-on cover 18 are installed back to their position. In order to insure that the container does not open during shipping a tape 50 may be applied circumferentially at the interface between the cover 16 and its cover 18 as shown in FIGS. 4 and 5.

Liner 12 provides an effective holding means for containing the desired substance within the drum 20 that said substance is not contaminated by the shell.

The thickness of the shell itself may be varied as desired in accordance with the level of thermal insulation required. The drum has preferably a standard size so that the container may be shipped and stacked with other standard drums.

Obviously, numerous modifications may be made to the invention by one skilled in the art without departing form its scope as defined in the appended claims.

What is claimed is:

1. A thermal container comprising;

a cylindrical liner blow molded from polyethylene and having a top with two necks and screw type plugs for closing said necks;

an insulating shell formed of two mating members, molded from expanded polystryene, each member having a cavity and a hole, said members cooperating to enclose said liner in their mated position within the cavities, said holes corresponding to said necks; said members being further provided with inserts for closing said holes for covering said necks;

a fiber drum for housing said shell, said drum being dimensioned to fit closely around said shell and further being provided with a circumferential bottom metal chime; and a fiber cover which fits over said drum to cover said shell.

* * * * *